US011855351B2

(12) United States Patent
Li et al.

(10) Patent No.: US 11,855,351 B2
(45) Date of Patent: Dec. 26, 2023

(54) BASE STATION ANTENNA FEED BOARDS HAVING RF TRANSMISSION LINES OF DIFFERENT TYPES FOR PROVIDING DIFFERENT TRANSMISSION SPEEDS

(71) Applicant: CommScope Technologies LLC, Hickory, NC (US)

(72) Inventors: Haifeng Li, Richardson, TX (US); Peter J. Bisiules, LaGrange Park, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/539,707

(22) Filed: Dec. 1, 2021

(65) Prior Publication Data

US 2022/0190486 A1 Jun. 16, 2022

Related U.S. Application Data

(60) Provisional application No. 63/126,215, filed on Dec. 16, 2020.

(51) Int. Cl.

| | |
|---|---|
| ***H01Q 21/00*** | (2006.01) |
| ***H01Q 1/24*** | (2006.01) |
| ***H01P 3/06*** | (2006.01) |
| ***H01P 3/00*** | (2006.01) |
| ***H01P 5/08*** | (2006.01) |
| ***H01P 9/00*** | (2006.01) |
| ***H01Q 3/34*** | (2006.01) |
| ***H01P 1/18*** | (2006.01) |

(52) U.S. Cl.

CPC ..... *H01Q 21/0075* (2013.01); *H01P 1/184* (2013.01); *H01P 3/003* (2013.01); *H01P 3/06* (2013.01); *H01P 5/085* (2013.01); *H01P 9/00* (2013.01); *H01Q 1/246* (2013.01); *H01Q 3/34* (2013.01)

(58) Field of Classification Search

CPC .. H01P 1/184; H01P 1/181; H01P 1/18; H01P 9/00; H01Q 21/0075; H01Q 3/34

USPC ..... 333/161, 156

See application file for complete search history.

(56) References Cited

U.S. PATENT DOCUMENTS 4,287,384 A 9/1981 Saito
5,694,134 A * 12/1997 Barnes ..... H01P 7/088 333/161
6,061,035 A * 5/2000 Kinasewitz et al. ..... H01Q 21/0075 343/770

(Continued)

FOREIGN PATENT DOCUMENTS

EP 1212809 A1 6/2002

OTHER PUBLICATIONS

Goel et al. "A Low-Cost Phased Array Antenna Integrated with Phase Shifters Cofabricated on the Laminate" Progress In Electromagnetics Research B 30:255-277 (2011).

(Continued)

*Primary Examiner* — Benny T Lee
(74) *Attorney, Agent, or Firm* — Myers Bigel, P.A.

(57) ABSTRACT

Base station antenna feed boards are provided. A base station antenna feed board includes a phase shifter and a hybrid radio frequency transmission line that is coupled to the phase shifter. The hybrid radio frequency transmission line includes a coplanar waveguide and a microstrip line. Related base station antennas are also provided.

25 Claims, 14 Drawing Sheets

(56) References Cited

U.S. PATENT DOCUMENTS

| | | | | |
|---|---|---|---|---|
| 6,646,522 | B1 * | 11/2003 | Kozyrev et al. | H01P 1/181 333/161 |
| 7,907,096 | B2 | 3/2011 | Timofeev et al. | |
| 10,971,788 | B1 * | 4/2021 | Weale | H01P 1/181 |
| 2008/0197945 | A1 * | 8/2008 | Franson | H01Q 13/085 333/238 |

OTHER PUBLICATIONS

Notification of Transmittal of the International Search Report and the Written Opinion of the International Searching Authority, or the Declaration, in corresponding PCT Application No. PCT/US2021/061521 (dated Mar. 31, 2022).

* cited by examiner

BASE STATION ANTENNA FEED BOARDS HAVING RF TRANSMISSION LINES OF DIFFERENT TYPES FOR PROVIDING DIFFERENT TRANSMISSION SPEEDS

CROSS-REFERENCE TO RELATED APPLICATION

The present application claims priority to U.S. Provisional Patent Application No. 63/126,215, filed Dec. 16, 2020, the entire content of which is incorporated herein by reference.

FIELD

The present invention generally relates to wireless communications systems and, more particularly, to radio frequency ("RF") transmission lines on base station antenna feed boards.

BACKGROUND

Base station antennas for wireless communication systems are used to transmit RF signals to, and receive RF signals from, fixed and mobile users of a cellular communications service. Base station antennas often include a linear array or a two-dimensional array of radiating elements, such as crossed-dipole or patch radiating elements. To change the down-tilt angle of the antenna beam generated by a linear array of radiating elements, a phase taper may be applied across the radiating elements. Such a phase taper may be applied by adjusting the settings of an adjustable phase shifter that is positioned along an RF transmission path (including an RF transmission line) between a radio and the individual radiating elements of the base station antenna.

One known type of phase shifter is an electromechanical rotating "wiper"-type phase shifter that includes a main printed circuit board ("PCB") and a "wiper" PCB that may be rotated above the main PCB. Such a rotating wiper-type phase shifter typically divides an input RF signal that is received at the main PCB into a plurality of sub-components, and then capacitively couples at least some of these sub-components to the wiper PCB. These sub-components of the RF signal may be capacitively coupled from the wiper PCB back to the main PCB along a plurality of arc-shaped traces, where each arc has a different radius. Each end of each arc-shaped trace may be connected to a radiating element or to a sub-group of radiating elements. By physically rotating the wiper PCB above the main PCB, the location where the sub-components of the RF signal capacitively couple back to the main PCB may be changed, thereby changing the path lengths that the sub-components of the RF signal traverse when passing from a radio to the radiating elements. These changes in the path lengths result in changes in the phases of the respective sub-components of the RF signal, and because the arcs have different radii, the change in phase experienced along each path differs.

Typically, the phase taper is applied by applying positive phase shifts of various magnitudes (e.g., +X°, +2X° and +3X°) to some of the sub-components of the RF signal and by applying negative phase shifts of the same magnitudes (e.g., −X°, −2X° and −3X°) to additional of the sub-components of the RF signal. Thus, the above-described rotary wiper-type phase shifter may be used to apply a phase taper to the sub-components of an RF signal that are transmitted through the respective radiating elements (or sub-groups of radiating elements). Example phase shifters of this variety are discussed in U.S. Pat. No. 7,907,096, the disclosure of which is hereby incorporated herein by reference in its entirety. The wiper PCB is typically moved using an actuator that includes a direct current ("DC") motor that is connected to the wiper PCB via a mechanical linkage. These actuators are often referred to as "RET" actuators because they are used to apply remote electrical down-tilt. RET actuators can also apply down-tilt to non-rotational phase shifters, such as trombone or sliding dielectric phase shifters.

A feed board (e.g., a PCB) of a base station antenna may be shared by various components, including phase shifters, radiating elements, and RF transmission lines. The feed boards are typically made as small as possible to reduce cost. As a result, the feed board may be relatively crowded. Moreover, to ensure that the RF transmission lines on the feed board that extend between the outputs of the phase shifters and the radiating elements have matching phase delays, the RF transmission lines may be lengthy, meandering lines, thereby exacerbating crowding of the feed board. As a result, the RF transmission lines may be very close to each other, which may cause high mutual coupling.

SUMMARY OF THE INVENTION

Pursuant to embodiments of the present invention, a base station antenna may include a PCB having a phase shifter and a plurality of RF transmission lines that are coupled to the phase shifter. Moreover, the base station antenna may include a plurality of radiating elements that are on the PCB and coupled to the RF transmission lines. A first of the RF transmission lines may include a coplanar waveguide ("CPW") that is coupled to a first of the radiating elements. A second of the radiating elements may be coupled to a second of the RF transmission lines that is shorter than the first of the RF transmission lines.

In some embodiments, the first of the radiating elements may be farther than the second of the radiating elements from the phase shifter.

According to some embodiments, the second of the RF transmission lines may include a microstrip line and may be free of any CPW. Moreover, the first of the RF transmission lines may include at least one microstrip line. The at least one microstrip line of the first of the RF transmission lines may include, for example: a first microstrip line that couples the CPW to the phase shifter; and a second microstrip line that couples the CPW to the first of the radiating elements.

In some embodiments, the CPW may include three coplanar conductive lines on a first surface of the PCB. The CPW may also include grounded vias that couple two of the conductive lines to a ground plane that is on a second surface of the PCB that is opposite the first surface. For example, first and second rows of the grounded vias may be on first and second portions, respectively, of the ground plane. Moreover, the ground plane may have an opening therein that is between the first and second portions of the ground plane.

According to some embodiments, the base station antenna may include a reflector that faces the ground plane. The reflector may have an opening therein that is overlapped by a middle one of the conductive lines.

In some embodiments, the CPW may be a first of a plurality of CPWs of the PCB, and the phase shifter may be a first of a plurality of phase shifters of the PCB that are coupled to the CPWs, respectively.

According to some embodiments, the CPW may be further coupled to a third of the radiating elements. Moreover, the second of the RF transmission lines may be further coupled to a fourth of the radiating elements.

A base station antenna, according to some embodiments, may include a reflector having an opening therein. The base station antenna may include a PCB on the reflector and having a phase shifter and a plurality of RF transmission lines that are coupled to the phase shifter. Moreover, the base station antenna may include a plurality of radiating elements that are on the PCB and coupled to the RF transmission lines. A first of the RF transmission lines may be coupled to a first of the radiating elements and may include a CPW that overlaps the opening of the reflector.

In some embodiments, the first of the RF transmission lines may include a microstrip line that is coupled to the CPW. For example, the CPW may be coupled to the phase shifter by the microstrip line. As another example, the CPW may be coupled to the first of the radiating elements by the microstrip line. Moreover, the microstrip line may be a first of a pair of microstrip lines of the first of the RF transmission lines, and the CPW may be coupled between the pair of microstrip lines.

A base station antenna feed board, according to some embodiments, may include a phase shifter and a hybrid RF transmission line that is coupled to the phase shifter and includes a CPW and a microstrip line. The hybrid RF transmission line may be longer than any non-CPW RF transmission line of the base station antenna feed board.

In some embodiments, the CPW may be coupled to the phase shifter by the microstrip line.

According to some embodiments, the CPW may include two outer conductive lines on a first surface of the base station antenna feed board. The CPW may also include a center conductive line that is coupled to the microstrip line and is between the two outer conductive lines on the first surface of the base station antenna feed board. Moreover, the CPW may include grounded vias that couple the two outer conductive lines to a ground plane that is on a second surface of the base station antenna feed board that is opposite the first surface.

In some embodiments, the base station antenna feed board may include a second-layer conductive line that is on the second surface of the base station antenna feed board and is overlapped by the center conductive line. The base station antenna feed board may also include ungrounded vias that couple the center conductive line and the second-layer conductive line to each other. Moreover, the ground plane may have first and second portions that are overlapped by the two outer conductive lines, respectively. The ground plane may also have an opening that separates the second-layer conductive line from the first and second portions of the ground plane.

A base station antenna feed board, according to some embodiments, may include a phase shifter and first and second RF transmission lines that are coupled to the phase shifter and have first and second RF wave speeds, respectively. The second RF wave speed may be slower than the first RF wave speed.

In some embodiments, the first RF transmission line may be longer than the second RF transmission line. Moreover, the first RF transmission line may include a CPW, and the second RF transmission line may be a non-CPW RF transmission line.

According to some embodiments, the first RF transmission line may include a conductive line that is separated from a ground plane of the base station antenna feed board by air. Moreover, the base station antenna feed board may include a reflector, and a substrate of the base station antenna feed board may be between the ground plane and the reflector.

In some embodiments, the first RF transmission line may include a coaxial RF transmission line having a shield and a center conductor that is separated from the shield by air.

DETAILED DESCRIPTION OF THE INVENTION

Figure 1:
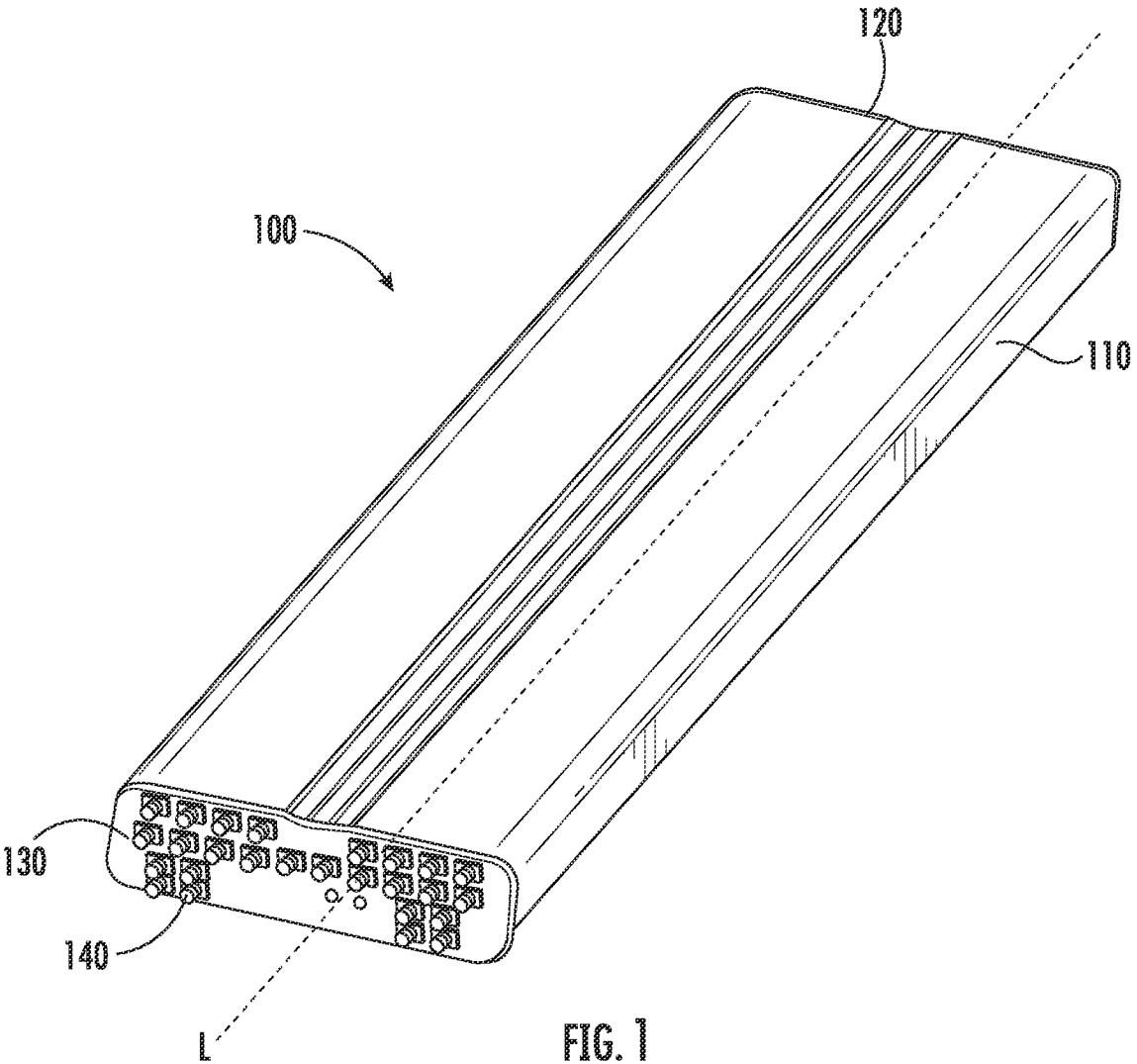
FIG. 1 is a front perspective view of a base station antenna according to embodiments of the present invention.

Pursuant to embodiments of the present invention, an RF transmission line on a base station antenna feed board may include RF transmission lines that have different transmission speeds. For example, whereas RF transmission lines on a conventional base station antenna feed board may all be microstrip-only lines, at least one RF transmission line according to embodiments of the present invention may include a different type of RF transmission line, such as a CPW RF transmission line.

As discussed above, a linear array of a base station antenna that includes remote electronic downtilt capabilities includes a phase shifter that is interposed between an RF input and the linear array. The phase shifter divides RF signals received at the RF input into a plurality of sub-components that are output at the respective outputs of the phase shifter. Each output of the phase shifter is connected by an RF transmission line to a group of one or more of the radiating elements of the linear array, so that all of the radiating elements in the linear array are connected to the phase shifter. Typically, the RF transmission lines are designed so that the phase shift between each output of the phase shifter and the associated radiating element(s) is the same. As a result, any phase shift that is applied to downtilt the antenna beam formed by the linear array is applied in the adjustable part of the phase shifter. With this design, all of the RF transmission lines that extend between the outputs of the phase shifter and the radiating elements of the linear array may have the same length. In other cases, the transmission lines may be designed to apply a fixed amount of downtilt to the antenna beams, and the adjustable portion of the phase shifter may be used to increase or decrease the amount of downtilt from the fixed downtilt. In this case, the RF transmission lines that extend from the outputs of the phase shifter to the groups of one or more of the radiating elements of the linear array may have different lengths, and the difference in lengths may be set based on the desired amount of fixed downtilt.

In most base station antennas, the phase shifters are mounted behind the reflector of the antenna and are connected to the feed boards by coaxial cables. The lengths of the coaxial cables may be selected so that the desired phase relationship may be maintained between each output of the phase shifter and its associated radiating elements. When the phase shifter is implemented on the feed board, the desired phase relationship must be achieved by setting each RF transmission line on the feed board to have a desired length (e.g., all of the RF transmission lines having the same length). Thus, the lengths of these transmission lines are set by the distance from the phase shifter to the farthest radiating elements in the linear array. For example, if all of the RF transmission lines are to have the same phase delay, then all of the RF transmission lines will be designed to have the same length, where the length is set by the distance between the phase shifter and the radiating element(s) that are the farthest from the phase shifter. As described above, this typically requires that the RF transmission lines that extend between the phase shifter and closer radiating elements be heavily meandered to obtain the requisite length, resulting in a crowded feed board with RF transmission lines that are in close proximity to each other. This results in increased mutual coupling between the RF transmission lines.

The speed at which an RF signal travels within an RF transmission line may vary based on the type of RF transmission line used. In particular, RF signals may travel faster in RF transmission lines having better shielding and/or lower dielectric constant transmission paths. For example, an RF signal travels faster in a CPW RF transmission line than in a microstrip RF transmission line. Accordingly, by using a CPW RF transmission line to couple a phase shifter on a feed board to a farthest radiating element on the feed board, the total amount of phase shift experienced by an RF signal that traverses the CPW RF transmission line may be reduced. As a result, the length of other (e.g., microstrip) RF transmission lines on the feed board may be reduced, since these microstrip RF transmission lines now have to induce less phase shift. These shortened microstrip RF transmission lines will exhibit lower insertion losses than conventional-length RF transmission lines. Moreover, because the shortened RF transmission lines occupy less space on the feed board than conventional-length RF transmission lines, distances between the RF transmission lines can be larger, thus reducing mutual coupling between the RF transmission lines.

Figure 4:
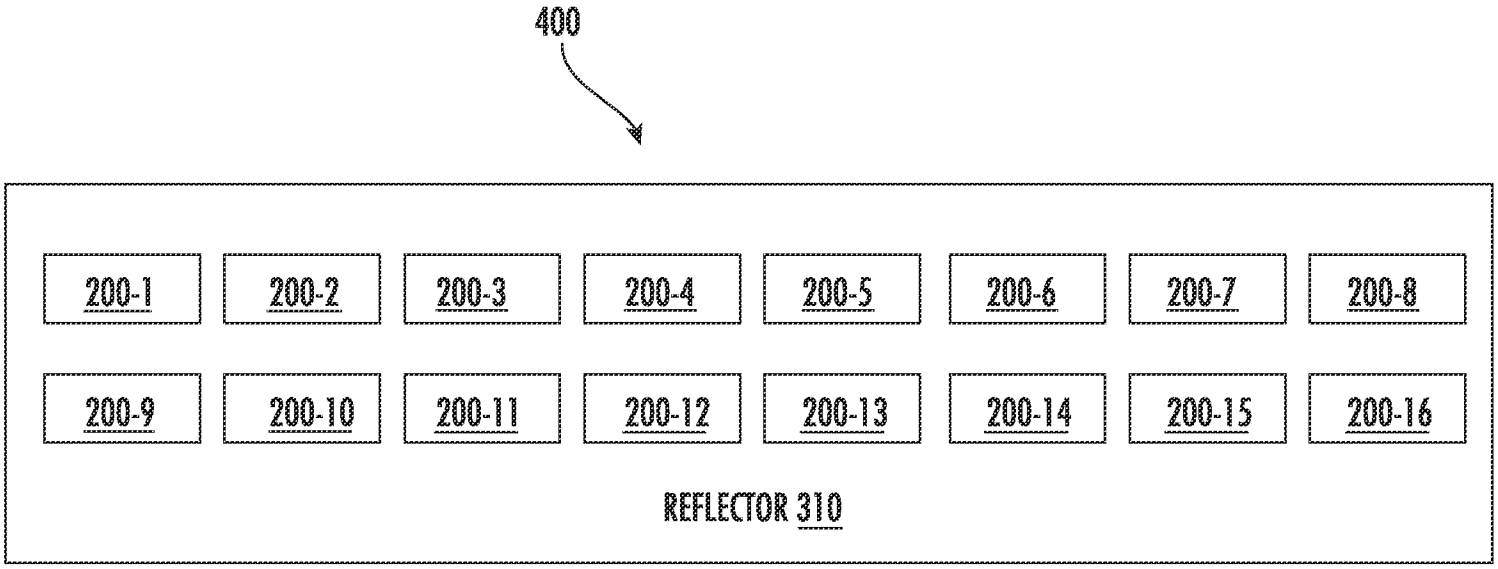
FIG. 4 is a front view of an antenna assembly that includes a plurality of feed boards according to embodiments of the present invention.

FIG. 1 is a front perspective view of a base station antenna 100 according to embodiments of the present invention. The antenna 100 may be, for example, a cellular base station antenna at a macrocell base station. It will be appreciated, however, that the techniques disclosed herein may also be applied to other base station antennas such as, for example, small cell base station antennas. As shown in FIG. 1, the antenna 100 is an elongated structure and has a generally rectangular shape. The antenna 100 includes a radome 110. In some embodiments, the antenna 100 further includes a top end cap 120 and/or a bottom end cap 130. The bottom end cap 130 may include a plurality of RF connectors 140 mounted therein. The connectors 140, which may also be referred to herein as "ports," are not limited, however, to being located on the bottom end cap 130. Rather, one or more of the connectors 140 may be provided on, for example, the rear (i.e., back) side of the antenna 100. The antenna 100 is typically mounted in a vertical configuration (i.e., the long side of the antenna 100 extends along a vertical axis L with respect to Earth). The connectors 140 may be coupled to groups of radiating elements 230-1, 230-2, 230-3, 230-4, 230-5, and 230-6 (FIG. 2A), collectively 230, through one or more feed boards 200 (FIGS. 2A and 4).

Figure 2A:
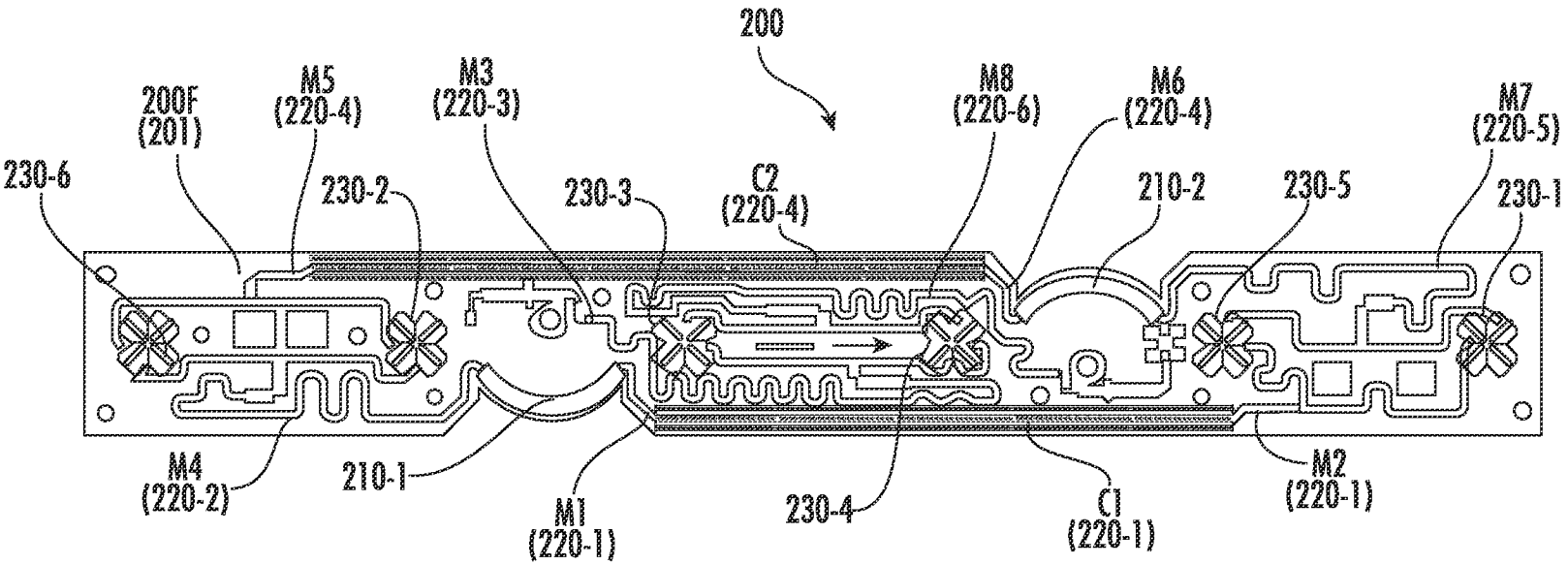
FIG. 2A is a front view of a base station antenna feed board according to embodiments of the present invention.

FIG. 2A is a front view of a base station antenna feed board 200 according to embodiments of the present invention. The feed board 200 may, in some embodiments, be a PCB that includes a substrate 201 and a plurality of RF transmission lines 220-1, 220-2, 220-3, 220-4, 220-5, and 220-6, collectively 220, that are on the substrate 201. For example, the substrate 201 may be a non-conductive (e.g., dielectric) substrate including a front surface 200F (FIGS. 3D, 3E, 3F, and 5) that has conductive (e.g., copper) traces of the transmission lines 220-1, 220-2, 220-3, 220-4, 220-5, and 220-6 thereon.

A plurality of phase shifters 210-1 and 210-2, collectively 210, and a plurality of radiating elements 230-1, 230-2, 230-3, 230-4, 230-5, and 230-6 may also be on the front surface 200F of the substrate 201. The wiper PCB of each phase shifter 210-1 and 210-2 is omitted in FIG. 2A to better illustrate the feed board 200. Each phase shifter 210-1 and 210-2 may be coupled to multiple ones of transmission lines 220-1, 220-2, 220-3, 220-4, 220-5, and 220-6, which are each coupled to at least one of radiating elements 230-1, 230-2, 230-3, 230-4, 230-5, and 230-6 (only the radiating element mounting locations are shown in FIG. 2A, and are labelled with reference numerals 230-1, 230-2, 230-3, 230-4, 230-5, and 230-6; it will be appreciated that a respective radiating element 230-1, 230-2, 230-3, 230-4, 230-5, and 230-6 will be mounted in each of the radiating element mounting locations shown in FIG. 2A). In some embodiments, each phase shifter 210-1 and 210-2 may have three RF outputs that are coupled to three respective ones of RF transmission lines 220-1, 220-2, 220-3, 220-4, 220-5, and 220-6, and each RF transmission line 220-1, 220-2, 220-3, 220-4, 220-5, and 220-6 may be coupled to two of radiating elements 230-1, 230-2, 230-3, 230-4, 230-5, and 230-6. As an example, the feed board 200 may have six radiating elements 230-1, 230-2, 230-3, 230-4, 230-5, and 230-6, as well as two phase shifters 210-1 and 210-2 that are each coupled to all of the radiating elements 230-1, 230-2, 230-3, 230-4, 230-5, and 230-6. The two phase shifters 210-1 and 210-2 are provided to feed RF signals having first and second polarizations to the radiating elements 230-1, 230-2, 230-3, 230-4, 230-5, and 230-6.

Specifically, the phase shifter 210-1 may be coupled to (i) radiating elements 230-1 and 230-5 via the transmission line 220-1, (ii) radiating elements 230-2 and 230-6 via the transmission line 220-2, and (iii) radiating elements 230-3 and 230-4 via the transmission line 220-3. Also, the phase shifter 210-2 may be coupled to (a) the radiating elements 230-2 and 230-6 via the transmission line 220-4, (b) the radiating elements 230-1 and 230-5 via the transmission line 220-5, and (c) the radiating elements 230-3 and 230-4 via the transmission line 220-6. The radiating elements 230-1, 230-2, 230-3, 230-4, 230-5, and 230-6 may be, for example, dual-polarized crossed-dipole radiating elements, and the phase shifters 210-1 and 210-2 may be coupled to respective dipoles (which may have respective polarizations) of each of radiating element 230-1, 230-2, 230-3, 230-4, 230-5, and 230-6. As used herein, the term "coupled" refers to electrical coupling/connection and may, in some embodiments, also refer to physical coupling/connection.

Some of the transmission lines 220-1 220-2, 220-3, 220-4, 220-5, and 220-6 may be of a different type from others of the transmission lines 220-1 220-2, 220-3, 220-4, 220-5, and 220-6. For example, the transmission lines 220-1 and 220-4 may include respective CPWs C1 and C2 that are coupled to the phase shifters 210-1 and 210-2, respectively, whereas the transmission lines 220-2, 220-3, 220-5, and 220-6 may be non-CPW transmission lines. Specifically, in some embodiments, the transmission lines 220-1 and 220-4 may be hybrid RF transmission lines that include the CPWs C1 and C2, respectively, and that each further include at least one microstrip line. As shown in FIG. 2A, the CPW C1 is coupled between a pair of microstrip lines M1 and M2 of the transmission line 220-1. Similarly, the transmission line 220-4 is shown as having a pair of microstrip lines M5 and M6 that the CPW C2 is coupled between. The transmission lines 220-2, 220-3, 220-5, and 220-6, on the other hand, are shown as having microstrip lines M4, M3, M7, and M8, respectively, while being free of any CPW.

In some embodiments, the microstrip line M2 may be shortened and the CPW C1 can be extended to be closer to the radiating elements 230-1 and 230-5 than what is shown in FIG. 2A. Using more of the CPW C1 in this manner, however, may require extending an opening 320-1 (FIG. 3B) in a reflector 310 (FIG. 3B) to correspond to the extended CPW C1 length, thus bringing the opening 320-1 (FIG. 3B) closer to the radiating elements 230-1 and 230-5 (FIG. 2A) and potentially negatively impacting the performance thereof.

The non-CPW transmission lines 220-2, 220-3, 220-5, and 220-6 are shorter than the transmission lines 220-1 and 220-4 that include the CPWs C1 and C2. Accordingly, the transmission lines 220-1 and 220-4 are the longest transmission lines on the feed board 200. By including the CPWs C1 and C2 in the longest transmission lines 220-1 and 220-4, the total electrical length of the transmission lines 220-1 and 220-4 can be shorter than it would be if the transmission lines 220-1 and 220-4 were non-CPW (e.g., microstrip-only) transmission lines. As a result, the physical lengths of the other transmission lines 220-2, 220-3, 220-5, and 220-6 can be shorter than they would be if the transmission lines 220-1 and 220-4 were non-CPW transmission lines. Specifically, the CPWs C1 and C2 allow relatively-short transmission lines 220-2, 220-3, 220-5, and 220-6 to match the phase (electrical length) of the longest transmission lines 220-1 and 220-4 (or to have a desired relationship between the phase shift of the different RF transmission lines).

Figure 2B:
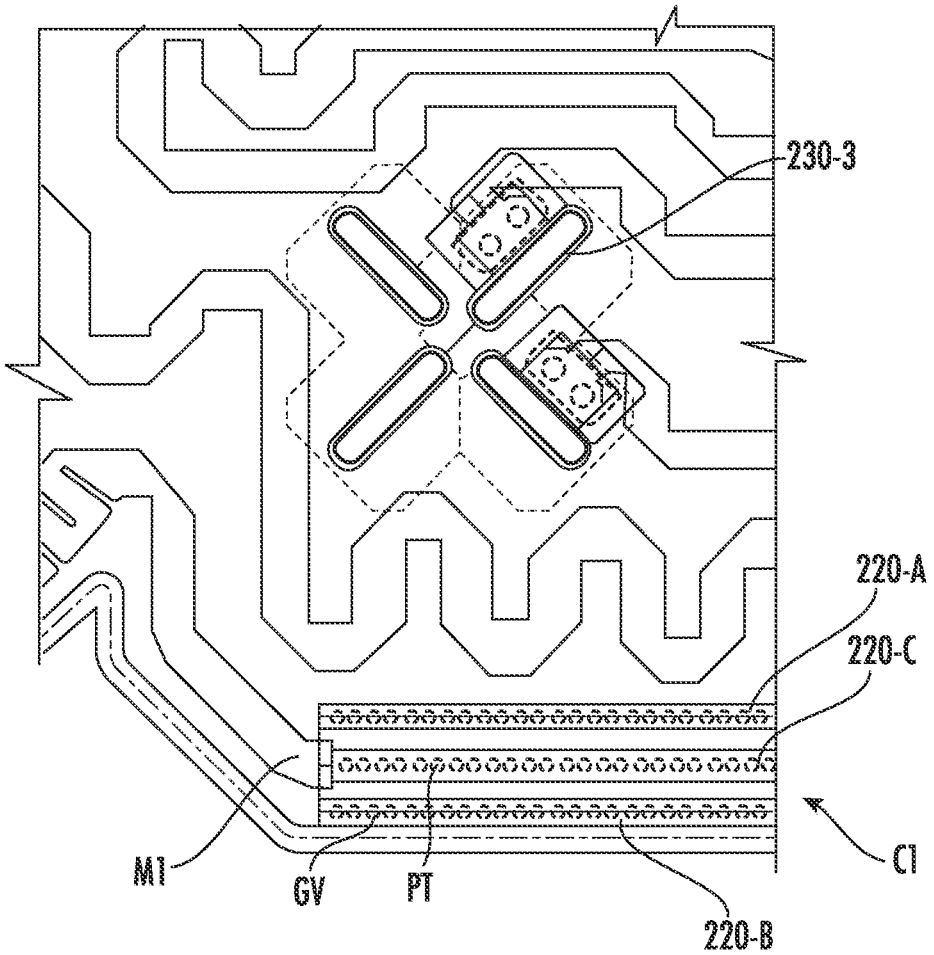
FIGS. 2B and 2C are enlarged partial front views of the feed board of FIG. 2A.
Figure 2C:
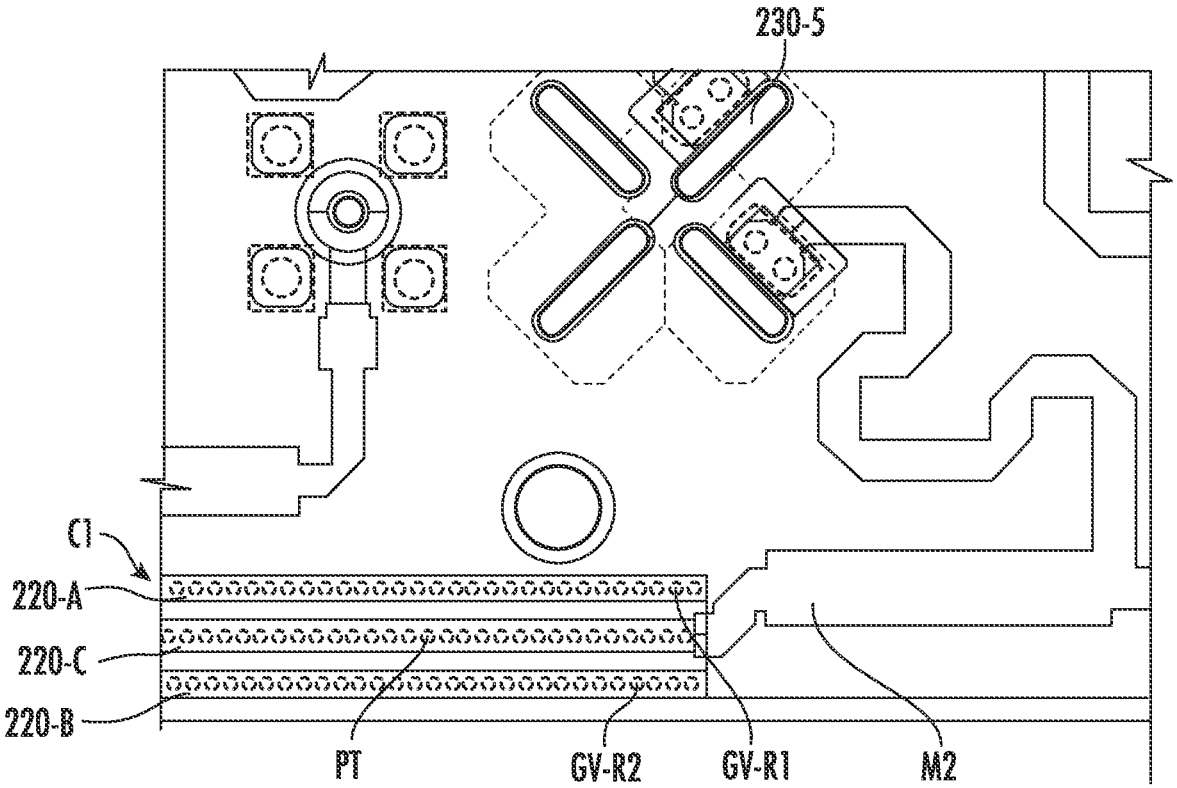

FIGS. 2B and 2C are enlarged partial front views of the feed board 200 of FIG. 2A. Specifically, FIGS. 2B and 2C show enlarged views of opposite ends, respectively, of the CPW C1 that is on the feed board 200. Referring to FIGS. 2A and 2B, the CPW Cl may be coupled to the phase shifter 210-1 (FIG. 2A) by the microstrip line M1 (FIG. 2B). Moreover, the CPW C1 includes three coplanar conductive lines 220-A, 220-B, and 220-C (as shown in FIGS. 2B and 2C) that are on the front surface of the feed board 200 (as shown in FIG. 2A). The conductive line 220-C is a middle/center conductive line that is between the two grounded outer conductive lines 220-A and 220-B. As shown in FIG. 2B, the middle/center conductive line 220-C may be physically and electrically coupled to the microstrip line M1.

In some embodiments, the CPW C1 may have grounded vias GV (FIG. 2B) therein. For example, grounded vias GV may couple the two outer conductive lines 220-A and 220-B to a ground plane 330 (FIG. 3C) that is on a back surface 200B (FIG. 3D) of the feed board 200. Moreover, the middle/center conductive line 220-C may, in some embodiments, also have vias (e.g., plated through holes) PT therein (and/or thereon). For example, a row of vias PT (FIG. 2B) may be coupled to the middle/center conductive line 220-C and to a second-layer conductive line 350 (FIG. 3D) that is electrically isolated from adjacent portions 330-A and 330-B (FIGS. 3E and 3F, respectively) of the ground plane 330 by an opening 340-1 (FIG. 3C) in the ground plane 330. Accordingly, the row of vias PT that is coupled to the middle/center conductive line 220-C may not be grounded. Rather, this row of vias PT (FIGS. 2B, 2C, and 3D) may function to increase capacitance between the middle/center conductive line 220-C and the two outer conductive lines 220-A and 220-B. This row of vias PT may, in some embodiments, penetrate the middle/center conductive line 220-C.

The middle/center conductive line 220-C may be an inner CPW trace, and the two outer conductive lines 220-A and 220-B may be CPW ground traces. In a CPW transmission line C1, a signal may transmit between the inner trace 220-C and the CPW ground traces 220-A and 220-B. Because the CPW C1 includes three traces 220-A, 220-B, and 220-C that use vias GV/PT (FIG. 2B) rather than simply a single layer of three traces without vias, capacitance between the inner trace 220-C and ground can be relatively large, thus allowing a large gap (e.g., between the conductive line 220-C and the conductive lines 220-A and 220-B) for a 50-Ohm transmission line that may not be possible with a single copper layer (of three traces without vias). As a result, manufacture of the PCB 200 can be enhanced and a short-circuit risk can be reduced by using the CPW C1. Moreover, this CPW C1 design provides lower loss and shorter electrical length for the same physical length.

Referring to FIGS. 2A and 2C, the CPW C1 may be coupled to the radiating elements 230-1 (FIG. 2A) and 230-5 (FIGS. 2A and 2C) by the microstrip line M2. As shown in FIG. 2C, the middle/center conductive line 220-C of the CPW C1 may be physically and electrically coupled to the microstrip line M2. The radiating element 230-1 (FIG. 2A) is the farthest of the radiating elements from the phase shifter 210-1 (FIG. 2A). Accordingly, the transmission line 220-1 that includes (i) the CPW C1 and (ii) at least one microstrip line (e.g., the microstrip line M2 and/or the microstrip line M1) is the longest of the transmission lines that is coupled to the phase shifter 210-1.

Multiple rows of vias GV/PT (FIG. 2B) may be coupled to the CPW C1. For example, a first row GV-R1 of grounded vias GV may be coupled to the outer conductive line 220-A and a second row GV-R2 of grounded vias GV may be coupled to the outer conductive line 220-B as shown in FIG. 2C. In some embodiments, the rows GV-R1 and GV-R2 may extend substantially the entire length of the CPW C1. As an example, the rows GV-R1 and GV-R2, along with the CPW C1 itself, may extend about 125-144 millimeters. The microstrip line M1 is shorter than the CPW C1. Moreover, the microstrip line M2 may, in some embodiments, be shorter than the CPW C1.

Figure 3A:
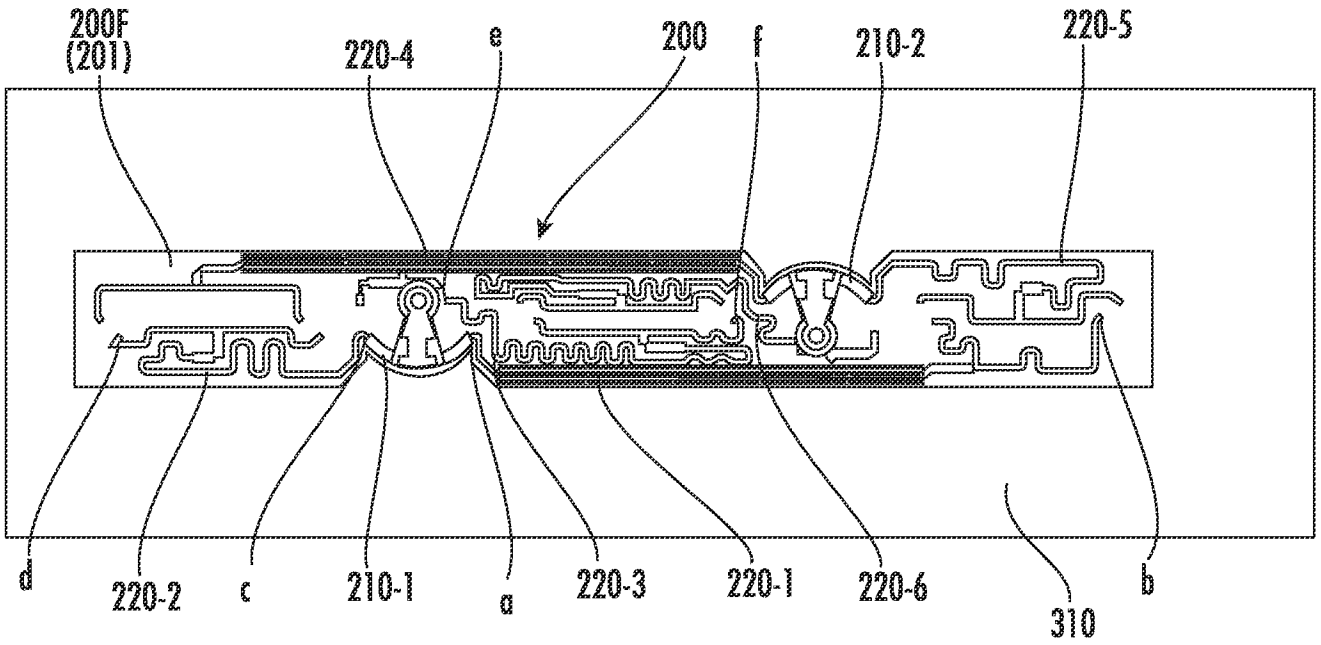
FIG. 3A is a front view of the feed board of FIG. 2A on a reflector.

FIG. 3A is a front view of the feed board 200 of FIG. 2A on a reflector 310. For simplicity of illustration, the radiating elements and their respective mounting locations (FIG. 2A) are omitted from view. FIG. 3A shows (i) opposite ends a and b of the transmission line 220-1, (ii) opposite ends c and d of the transmission line 220-2, and (iii) opposite ends e and f of the transmission line 220-3. The ends a, c, and e are at (or adjacent) respective output nodes of the phase shifter 210-1. The ends b, d, and f are at (or adjacent) respective radiating elements. The distance between the opposite ends a and b, which is the longest distance from the phase shifter 210-1 to any of the radiating elements, may be fixed. Moreover, the transmission lines 220-2 and 220-3 that are between the respective pairs of opposite ends c and d and e and f may need to, for example, have the same phase (electrical length) as the transmission line 220-1 that is between the opposite ends a and b. Accordingly, by including the CPW C1, which has a shorter electrical length than a corresponding microstrip line of the same physical length, in the transmission line 220-1, conductive traces of the transmission lines 220-2 and 220-3 can be shorter (e.g., have less meander) than the conductive traces would be if the conductive traces needed to match the electrical length of a conventional microstrip-only transmission line extending the entire distance between the opposite ends a and b. For example, the conductive traces of the transmission lines 220-2 and 220-3 may be no more than 83% of the length that they would be if they needed to match the electrical length of such a conventional microstrip-only transmission line between the ends a and b.

Figure 3B:
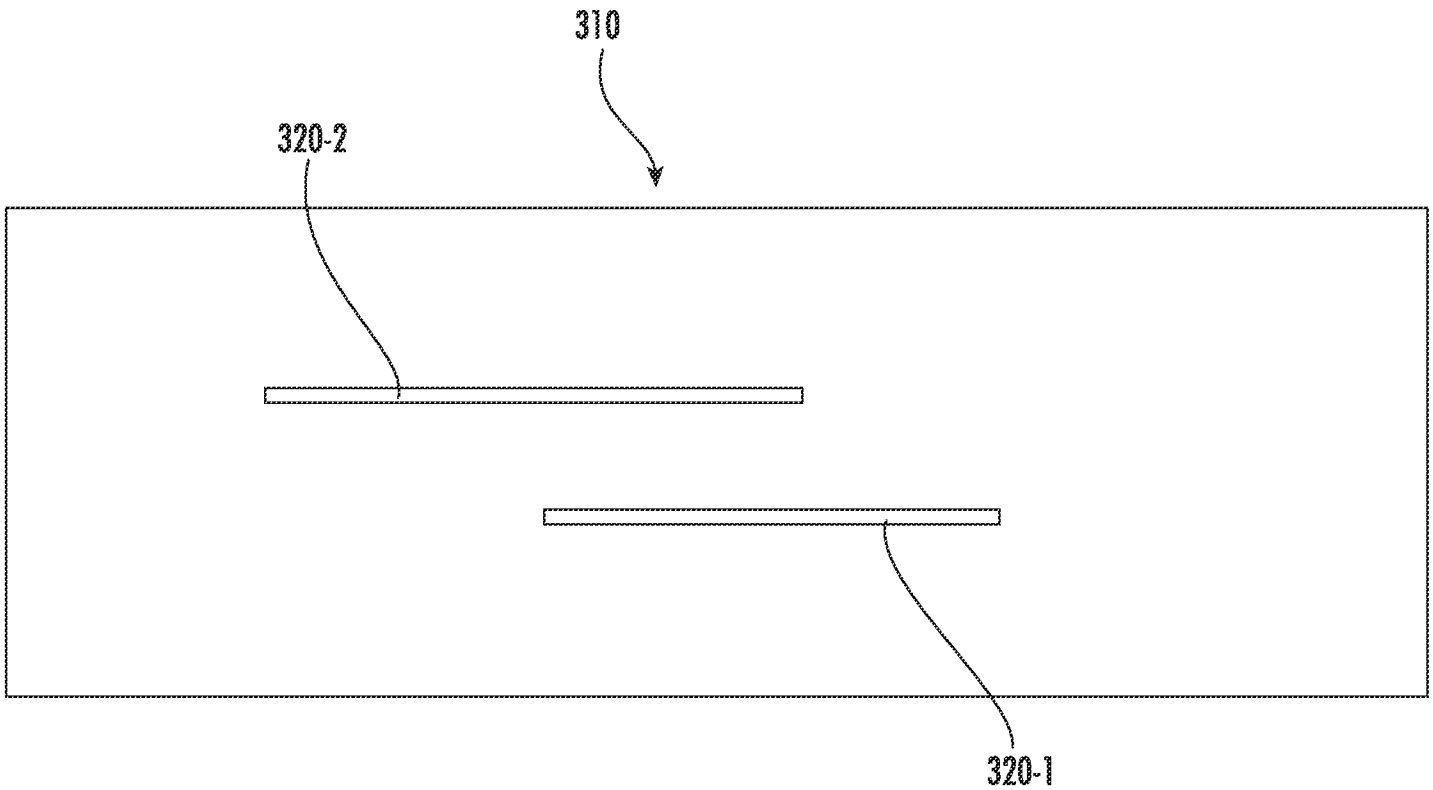
FIG. 3B is a front view of the reflector of FIG. 3A.

FIG. 3B is a front view of the reflector 310 of FIG. 3A, with the feed board 200 omitted from view. As shown in FIG. 3B, the reflector 310 may include at least one opening 320-1 and/or 320-2, collectively 320, therein. For example, two spaced-apart openings 320-1 and 320-2 may be respective slots/cutouts in the reflector 310, which may be a conductive (e.g., metal) reflector. FIG. 3B further shows that respective portions of the openings 320-1 and 320-2 may extend in parallel with each other, while ends of the opening 320-1 may not be aligned with ends of the opening 320-2. The openings 320-1 and 320-2 may correspond to the CPWs C1 and C2 (FIG. 2A), respectively. Specifically, the CPWs C1 and C2 may each include a middle/center conductive line 220-C (FIG. 2B) that overlaps the openings 320-1 and 320-2, respectively. As a result of the openings 320-1 and 320-2, vias PT along the signal trace (i.e., along the middle/center conductive line 220-C) do not short circuit to the reflector 310.

Moreover, in some embodiments, each of openings 320-1 and 320-2 may be wider than the middle/center conductive line 220-C. For example, the opening 320-1 may extend from a position under an inner portion of the row GV-R1 (FIG. 2C) to a position under an inner portion of the row GV-R2 (FIG. 2C).

Figure 3C:
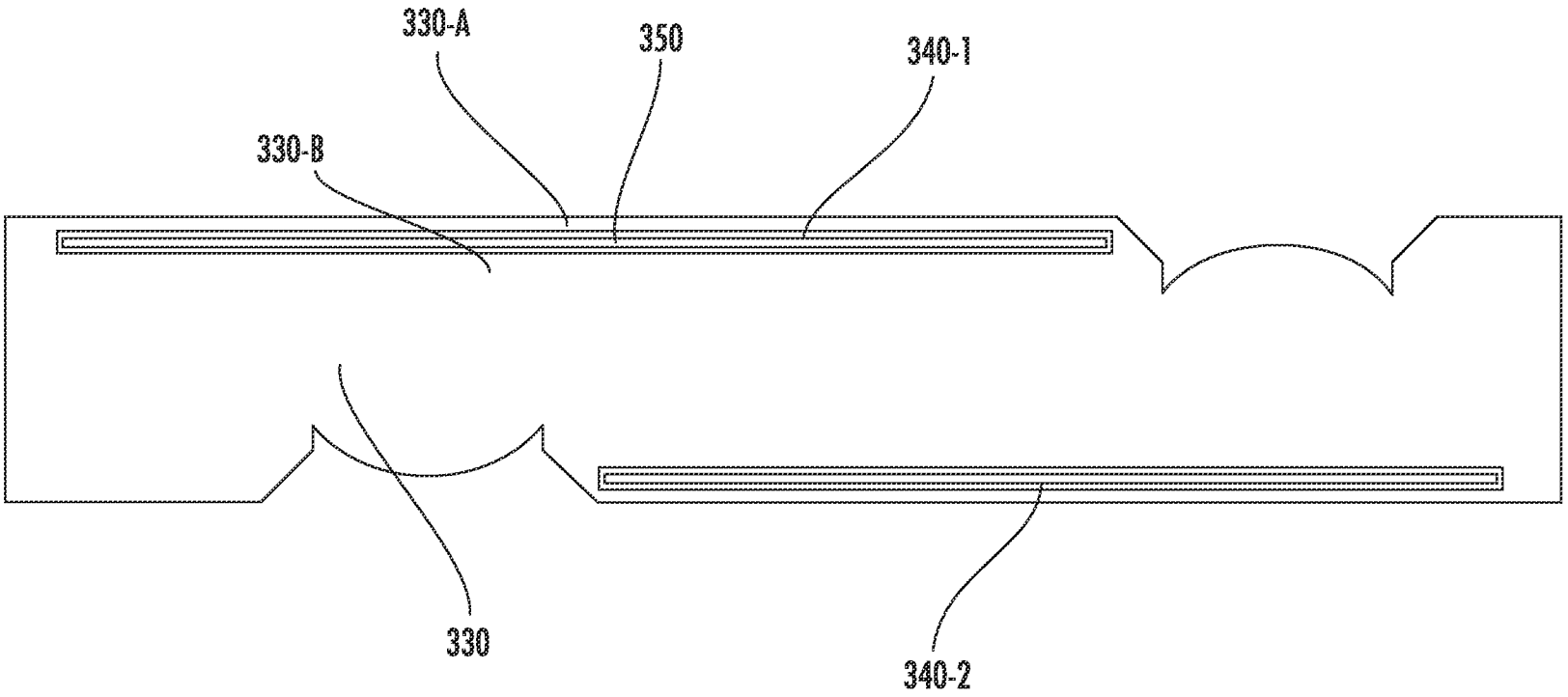
FIG. 3C is a rear view of a ground plane of the feed board of FIG. 2A.

FIG. 3C is a rear view of a ground plane 330 of the feed board 200 of FIG. 2A. The ground plane 330 may have at least one opening 340-1 and/or 340-2, collectively 340, therein. For example, as shown in FIG. 3C, the ground plane 330 may have two spaced-apart openings 340-1 and 340-2 therein. In some embodiments, each opening 340 extends continuously around a second-layer conductive line 350 that is coplanar with the ground plane 330. Each opening 340 may thus be larger (e.g., wider and longer) than each of the conductive line 350 and a middle/center conductive line 220-C (FIG. 3D) that overlaps the conductive line 350. The opening 340 and the conductive line 350 therefore may not function as parts of the ground plane 330. Rather, the opening 340 may electrically isolate the conductive line 350 (and the middle/center conductive line 220-C coupled thereto) from adjacent portions 330-A and 330-B of the ground plane 330 that the opening 340 extends between.

The portions 330-A and 330-B that are separated by the opening 340-1 therebetween may, in some embodiments, be overlapped by the conductive lines 220-A and 220-B (FIG. 2B), respectively, of the CPW C1. Because the conductive lines 220-C and 350, which may collectively be a hot line/trace, are coupled to each other and are electrically isolated from the ground plane 330 by the respective opening 340-1 and/or 340-2, the transmission line 220-1 may have a relatively short electrical length for its physical length. This structure can also result in lower loss and allow a relatively large gap between the conductive line 220-C and the conductive lines 220-A and 220-B.

Figure 3D:
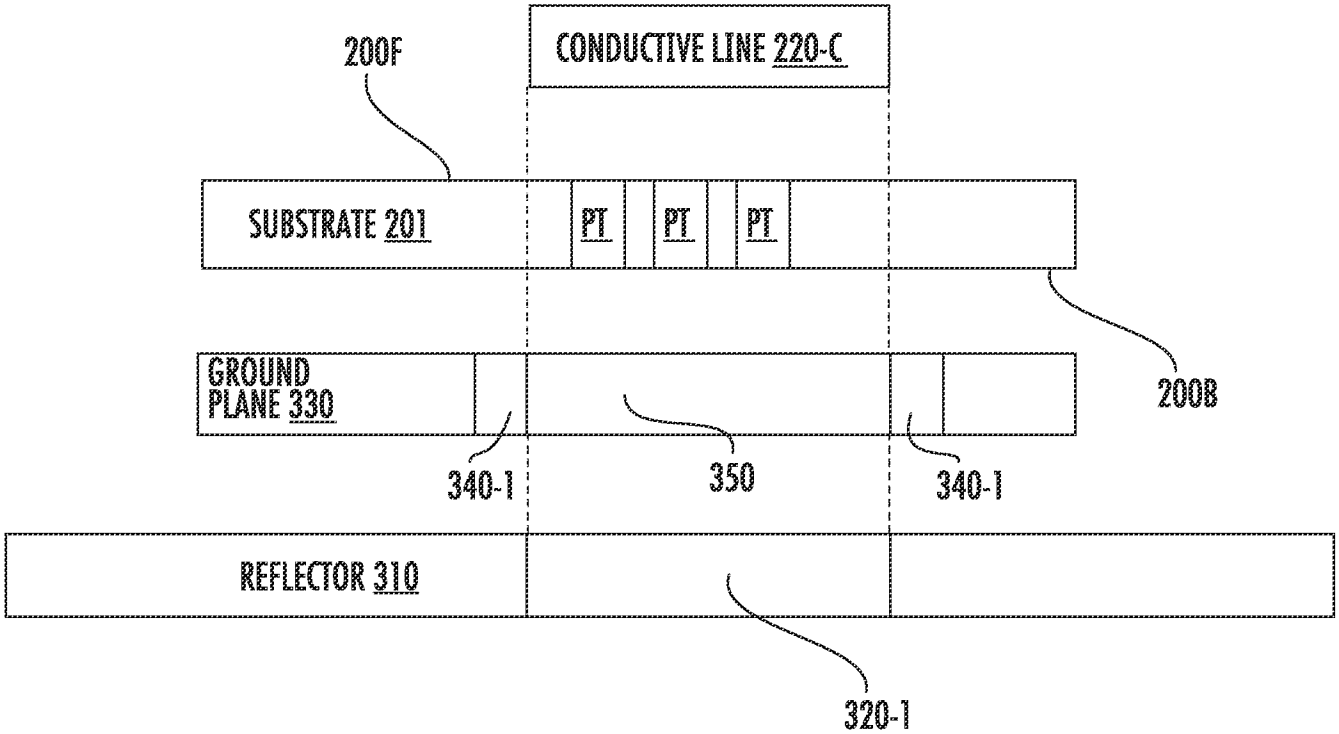
FIGS. 3D-3F are exploded schematic cross-sectional views along different conductive lines of the CPW of FIG. 2A.
Figure 3E:
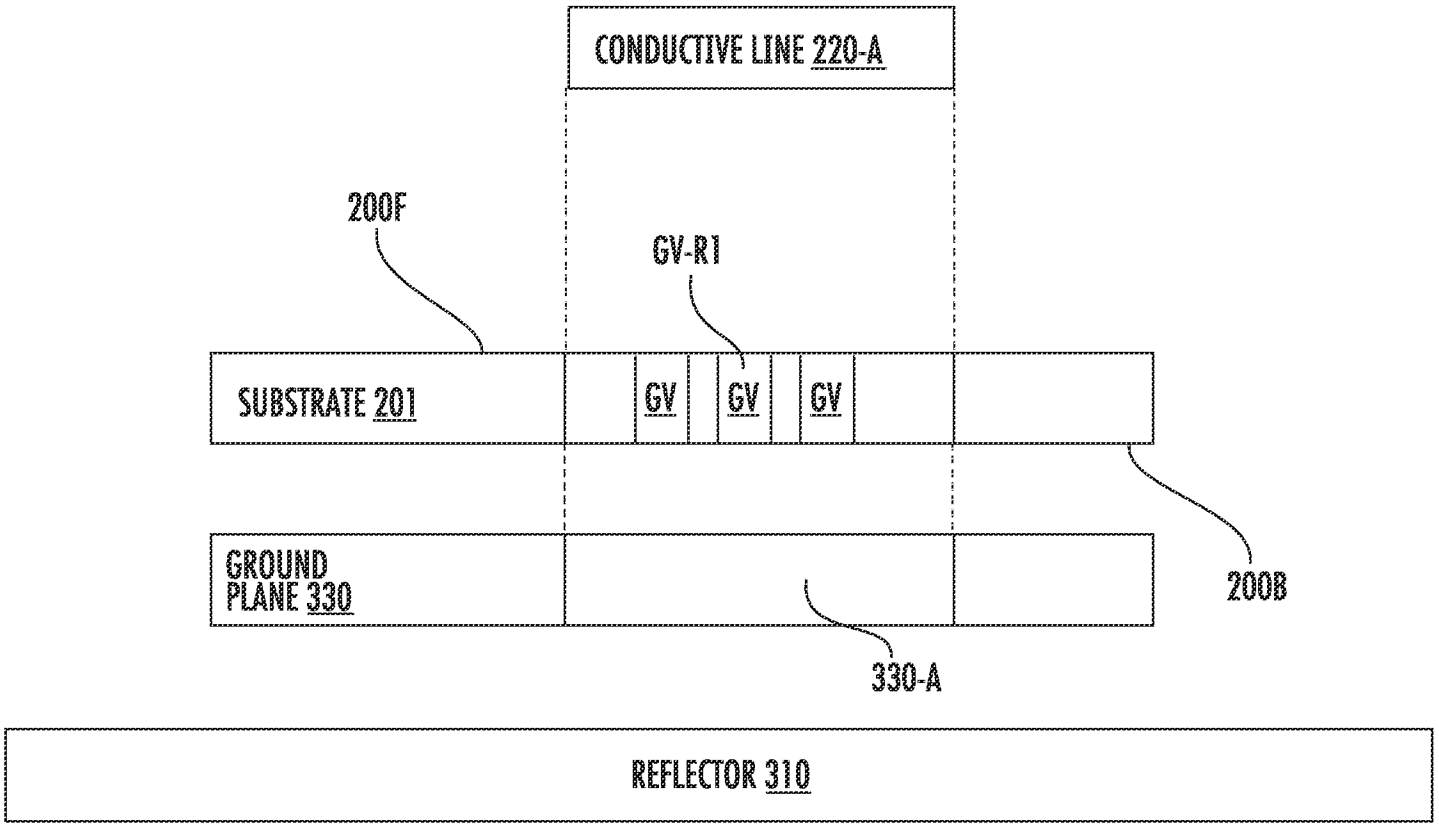
Figure 3F:
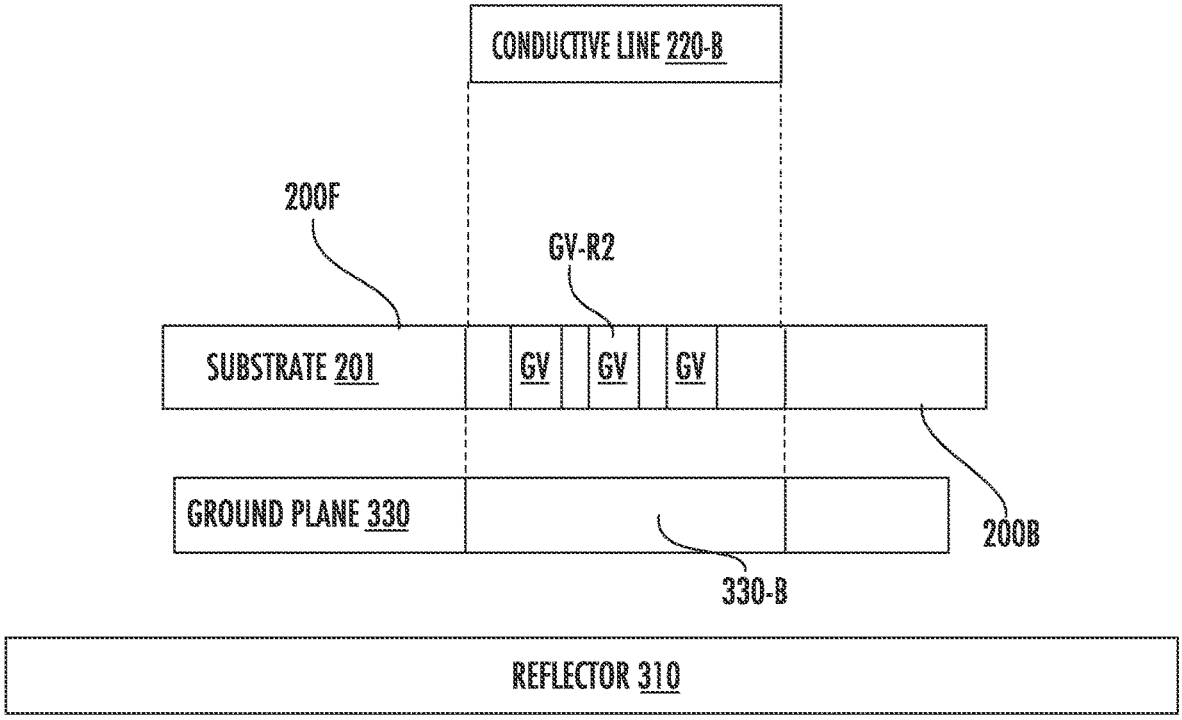

FIGS. 3D-3F are exploded schematic cross-sectional views along longitudinal directions of different conductive lines of the CPW C1 of FIG. 2A. FIG. 3D illustrates a cross-sectional view along a middle/center conductive line 220-C (FIG. 2B) of the CPW C1. As shown in FIG. 3D, the conductive line 220-C overlaps an opening 320-1 of the reflector 310. The conductive line 220-C also overlaps a second-layer conductive line 350 that is coplanar with and electrically isolated from adjacent portions 330-A and 330-B (FIG. 3C) of the ground plane 330. In some embodiments, the conductive line 350 may be a copper trace that is on the back surface 200B of the substrate 201. Moreover, vias PT that are in the substrate 201 may connect the conductive lines 220-C and 350 to each other.

FIG. 3D further illustrates that the ground plane 330 is between the reflector 310 and the substrate 201 of the feed board 200 (FIG. 2A). FIG. 3D also shows that the substrate 201 has a back surface 200B that is opposite the front surface 200F thereof. The reflector 310 thus faces the ground plane 330, which faces the back surface 200B of the substrate 201. Though omitted from view in FIG. 3D for simplicity of illustration, a dielectric layer (e.g., a gasket) may be between the ground plane 330 and the reflector 310.

FIG. 3E illustrates a cross-sectional view along an outer conductive line 220-A of the CPW C1 (FIG. 2C). As shown in FIG. 3E, the conductive line 220-A overlaps the portion 330-A of the ground plane 330. The conductive line 220-A also overlaps (and is electrically connected to) the row GV-R1 of grounded vias GV (FIGS. 2B and 2C) penetrating the substrate 201. The row GV-R1 overlaps and is further coupled to the portion 330-A of the ground plane 330. Accordingly, the conductive line 220-A is coupled to the portion 330-A of the ground plane 330 by the row GV-R1. Moreover, the ground plane 330 may be coupled/grounded to the reflector 310.

FIG. 3F illustrates a cross-sectional view along an outer conductive line 220-B of the CPW C1 (FIG. 2C). As shown in FIG. 3F, the conductive line 220-B overlaps the portion 330-B of the ground plane 330. The conductive line 220-B also overlaps (and is electrically connected to) the row GV-R2 of grounded vias GV (FIGS. 2B and 2C) penetrating the substrate 201. The row GV-R2 overlaps and is further coupled to the portion 330-B of the ground plane 330. Accordingly, the conductive line 220-B is coupled to the portion 330-B of the ground plane 330 by the row GV-R2.

For simplicity of illustration, the rows GV-R1 and GV-R2 are illustrated only in the substrate 201 of FIGS. 3E and 3F, respectively. In some embodiments, however, the rows GV-R1 and GV-R2 may also penetrate the conductive lines 220-A and 220-B, respectively.

FIG. 4 is a front view of an antenna assembly 400 that includes a plurality of feed boards 200 according to embodiments of the present invention. The feed boards 200 of the assembly 400 may all share the same reflector 310. For example, the assembly 400 may include two rows of feed boards 200. As shown in FIG. 4, a first row includes eight feed boards 200-1, 200-2, 200-3, 200-4, 200-5, 200-6, 200-7, and 200-8 on the reflector 310 and a second row includes another eight feed boards 200-9, 200-10, 200-11, 200-12, 200-13, 200-14, 200-15, and 200-16 on the reflector 310. The feed boards 200 may be mounted on the front side of the reflector 310. The assembly 400, which may be part of the antenna 100 (FIG. 1), thus has a total of sixteen feed boards 200-1 through 200-16. In antenna assemblies of other embodiments, however, more (e.g., at least eighteen) or fewer (e.g., one, two, four, six, eight, ten, twelve, or fourteen) feed boards 200 may be on the reflector 310. Moreover, each feed board 200 of the assembly 400 may include a CPW C1 (FIG. 2A) and/or a CPW C2 (FIG. 2A).

Figure 5:
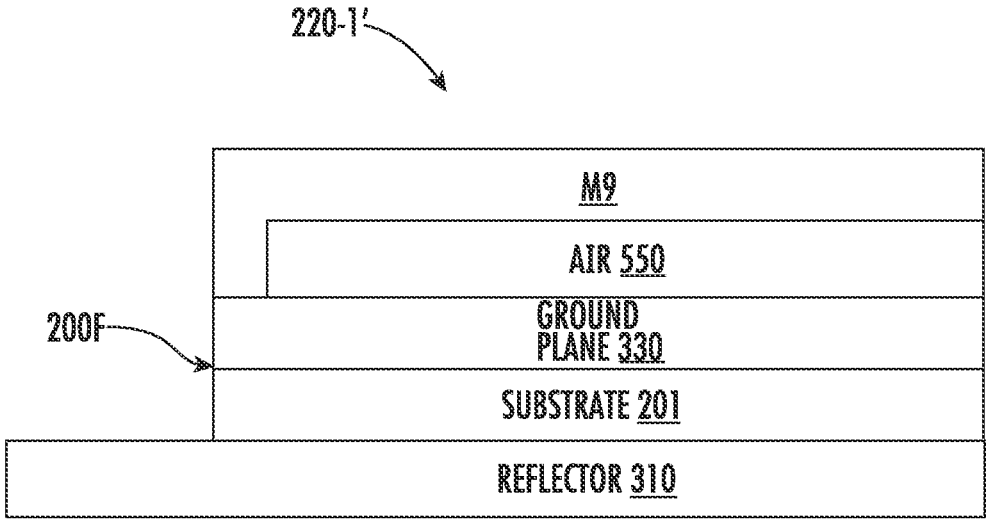
FIG. 5 is a schematic cross-sectional view along a portion of an RF transmission line comprising an air-microstrip line according to other embodiments of the present invention.

FIG. 5 is a schematic cross-sectional view along a portion (e.g., an end portion) of an RF transmission line 220-1' comprising an air-microstrip line according to other embodiments of the present invention. The transmission line 220-1' is a non-CPW transmission line. Specifically, the non-CPW transmission line 220-1' is an alternative to the transmission line 220-1 (FIG. 2A) that includes the CPW C1 (FIG. 2A). As such, the transmission line 220-1' may be coupled to the phase shifter 210-1 (FIG. 2A) and the radiating elements 230-1 and 230-5 (FIG. 2A), and may have opposite ends a and b (FIG. 3A). The air-microstrip line of the transmission line 220-1' comprises a conductive line M9 (e.g., a thin strip of metal), where air 550 is between a portion of the ground plane 330 and a portion of the conductive line M9. Moreover, the ground plane 330 may be on the front surface 200F of the substrate 201 of a feed board 200 (FIG. 4) that includes the transmission line 220-1'. The cross section shown in FIG. 5 is taken along a longitudinal direction/dimension of the substrate 201 and the transmission line 220-1'.

Figure 6:
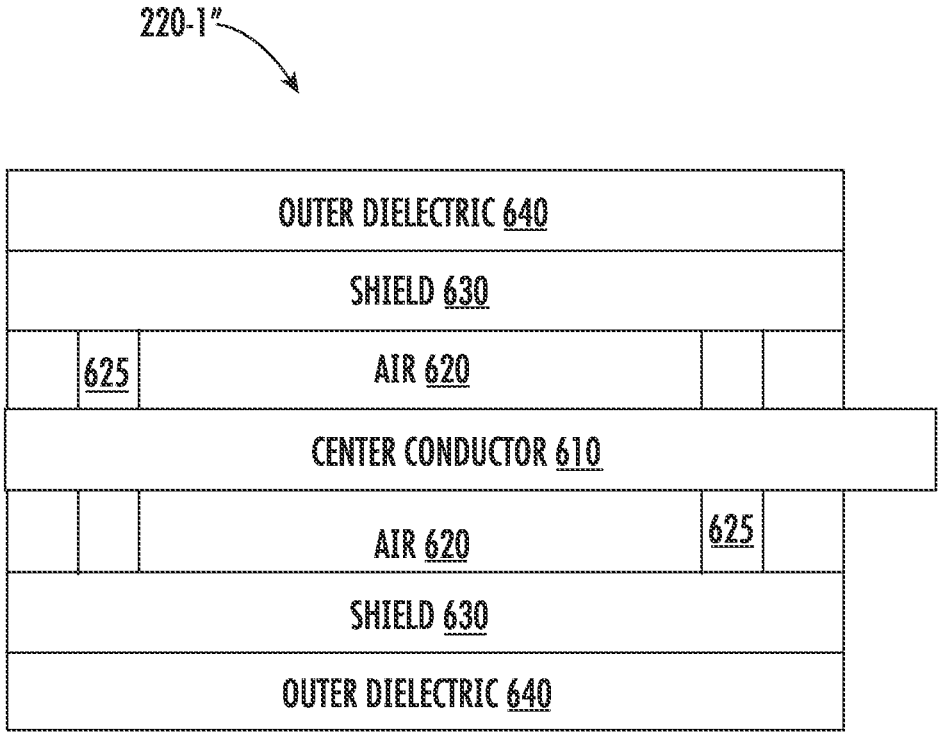
FIG. 6 is a schematic cross-sectional view along a portion of an RF transmission line comprising an air-coaxial line according to still other embodiments of the present invention.

FIG. 6 is a schematic cross-sectional view along a portion (e.g., an end portion) of an RF transmission line 220-1" comprising an air-coaxial line according to still other embodiments of the present invention. The transmission line 220-1", like the transmission line 220-1' (FIG. 5), is a non-CPW alternative to the transmission line 220-1 (FIG. 2A). As such, the transmission line 220-1" may be coupled to the phase shifter 210-1 (FIG. 2A) and the radiating elements 230-1 and 230-5 (FIG. 2A), and may have opposite ends a and b (FIG. 3A). The air-coaxial line of the transmission line 220-1" comprises a center conductor 610 that is surrounded mostly by air 620. A plurality of spaced-apart dielectric spacers 625 may also encircle portions of the center conductor 610 to provide structural support. Moreover, the air 620 and the spacers 625 may be surrounded (e.g., encircled) by a conductive shield 630 and an outer dielectric 640. The cross section shown in FIG. 6 is taken along a longitudinal direction/dimension of the transmission line 220-1".

RF signals may travel faster on the transmission lines 220-1, 220-1', and 220-1" than they would on a conventional microstrip transmission line, and therefore can each have shorter electrical length than would a section of microstrip transmission line having the same physical length. For example, the CPW C1 of the transmission line 220-1 can facilitate keeping electric fields in the air above the front surface 200F (FIG. 2A), thus helping to shorten electrical length. Moreover, if the transmission lines 220-1, 220-2, 220-3, 220-4, 220-5, and 220-6 in a network (e.g., on a feed board 200) were all conventional microstrip-only transmission lines, then the transmission lines may have an average insertion loss of 0.71 decibels ("dB"), whereas a transmission line network that includes the CPW C1 of the transmission line 220-1 may have a relatively-low average insertion loss, such as 0.66 dB. The air-microstrip line of the transmission line 220-1' can also have a relatively-low insertion loss, as air has lower dielectric losses than other dielectrics.

Figure 7:
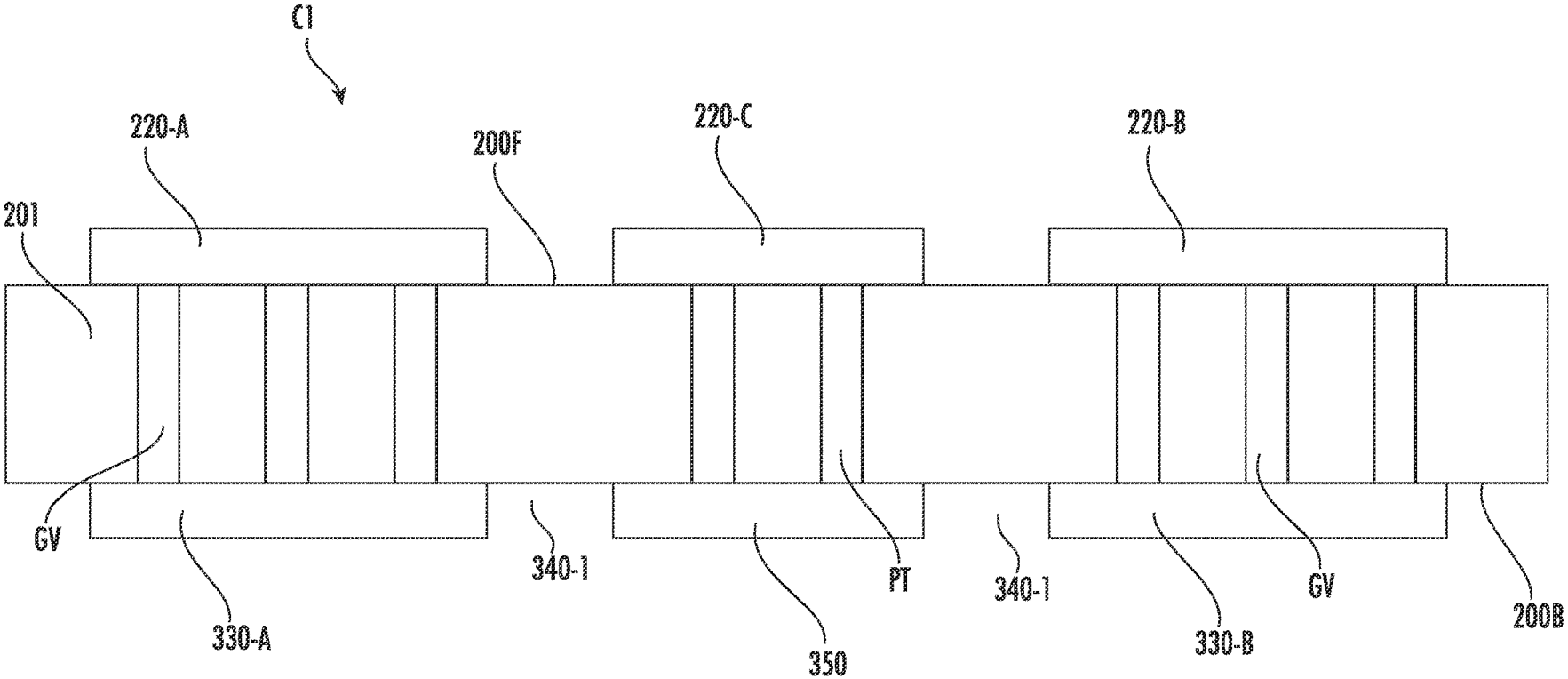
FIG. 7 is a cross-sectional view along a width direction of the CPW of FIG. 2A.

FIG. 7 is a cross-sectional view along a width direction of the CPW C1 of FIG. 2A. In some embodiments, the width direction may be perpendicular to the longitudinal direction that is shown in FIG. 3D. As shown in FIG. 7, the CPW C1 may be a double-layer CPW. Specifically, a conductive line 220-C of the CPW C1 may overlap a second-layer conductive line 350 of the CPW C1. For example, sidewalls of the conductive line 220-C may be aligned in a vertical direction with sidewalls of the conductive line 350. Moreover, the conductive lines 220-C and 350 may be coupled to each other by ungrounded vias PT, and thus may collectively function as a combined inner trace/transmission section of the CPW C1. The term "inner trace" may therefore refer to the conductive line 220-C and/or the conductive line 350.

If the conductive line 350 were instead removed from the transmission section of the CPW C1, a narrower gap (e.g., a narrower opening 340-1) may be needed between the inner trace and ground, which may negatively affect a PCB manufacturing process. Removal of the conductive line 350 may also increase losses and electrical length over a given physical length of the CPW C1.

FIG. 7 further illustrates that the transmission-section vias PT may, in some embodiments, be in multiple rows. Similarly, outer conductive lines 220-A and 220-B may each be coupled to multiple rows of grounded vias GV.

Base station antenna feed boards 200 (FIG. 2A) having an RF transmission line 220-1 (FIG. 2A) that includes a CPW C1 (FIG. 2A) according to embodiments of the present invention may provide a number of advantages. These advantages include allowing non-CPW transmission lines 220-2, 220-3, 220-5, and 220-6 (FIG. 2A) to match the phase shift/delay of the transmission line 220-1 while being significantly shorter (e.g., 18 millimeters shorter), due to the reduced electrical length provided by the CPW C1 (and by CPW C2 (FIG. 2A) of transmission line 220-4). Because an RF transmission wave can travel faster in a CPW than in a microstrip line, a phase delay of the CPW is smaller over a given length than it would be for the microstrip line over that same length. The non-CPW transmission lines 220-2, 220-3, 220-5, and 220-6 can thus have less meander, and increased spacing from adjacent transmission lines, than they would if the transmission lines 220-1 and 220-4 were instead conventional microstrip-only transmission lines. Due to their relatively-short lengths, the non-CPW transmission lines 220-2, 220-3, 220-5, and 220-6 can provide lower losses and lower mutual coupling.

The lower mutual coupling can increase isolation between ports. For example, isolation between two input ports can be an average of 5 dB better, relative to a network having all conventional microstrip-only transmission lines. Moreover, radiation pattern performance may improve. Power distribution can also be improved, as increased isolation between conductive traces of the transmission lines 220-1, 220-2, 220-3, 220-4, 220-5, and 220-6 can result in better power distribution. In some embodiments, performance (e.g., isolation performance, power distribution performance, etc.) may vary based on tilt angle/phase slant. As an example, the worst isolation performance may occur at a middle angle among a group of outputs of a phase shifter 210-1 or 201-2 (FIG. 2A).

As used herein, the terms "CPW" and "coplanar waveguide" may refer to any waveguide having coplanar conductive lines/traces. These terms are thus not limited to CPWs that use plated through holes. Nor are these terms limited to double-layers of copper. CPWs (e.g., CPWs C1 and C2) that include such features, however, can be advantageous. For example, a CPW that uses a double layer of copper and uses plated though holes connected to ground at each side and connected to a middle/inner trace can provide lower loss and a shorter electrical length relative to the same physical length of a single-layer CPW (i.e., three traces that do not use vias). Moreover, a large gap between the middle/inner trace and grounded outer traces can reduce PCB manufacturing risk.

It will be appreciated that the present specification only describes a few example embodiments of the present invention and that the techniques described herein have applicability beyond the example embodiments described above.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout the detailed description of the drawings.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between," "adjacent" versus "directly adjacent," etc.).

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A base station antenna comprising:

a printed circuit board (PCB) comprising a phase shifter and a plurality of radio frequency (RF) transmission lines that are coupled to the phase shifter; and a plurality of radiating elements that are on the PCB and coupled to the RF transmission lines, wherein a first of the RF transmission lines comprises a coplanar waveguide (CPW) that is coupled between a first of the radiating elements and the phase shifter, wherein a second of the radiating elements is coupled to a second of the RF transmission lines that is shorter in length than a length of the first of the RF transmission lines, wherein the second of the RF transmission lines is coupled between the second of the radiating elements and the phase shifter, and wherein the second of the RF transmission lines is free of any CPW.

2. The base station antenna of claim 1, wherein the first of the radiating elements is located farther from the phase shifter than the second of the radiating elements from the phase shifter.

3. The base station antenna of claim 1, wherein the second of the RF transmission lines comprises a microstrip line.

4. The base station antenna of claim 1, wherein the first of the RF transmission lines further comprises at least one microstrip line.

5. The base station antenna of claim 4, wherein the at least one microstrip line comprises:

a first microstrip line that couples the CPW to the phase shifter; and a second microstrip line that couples the CPW to the first of the radiating elements.

6. The base station antenna of claim 1, wherein the CPW comprises:

three coplanar conductive lines on a first surface of the PCB; and grounded vias that couple two of the coplanar conductive lines to a ground plane that is on a second surface of the PCB that is opposite the first surface.

7. The base station antenna of claim 6, wherein first and second rows of the grounded vias are on first and second portions, respectively, of the ground plane, and wherein the ground plane comprises an opening therein that is between the first and second portions of the ground plane.

8. The base station antenna of claim 6, wherein the three coplanar conductive lines comprise first, second, and third coplanar conductive lines, wherein the first and third coplanar conductive lines are the two of the coplanar conductive lines that are coupled to the ground plane by the grounded vias, and wherein the second coplanar conductive line is between the first and third coplanar conductive lines, the base station antenna further comprising:

a reflector that faces the ground plane, wherein the reflector comprises an opening therein that is overlapped by the second coplanar conductive line.

9. The base station antenna of claim 1, wherein the CPW comprises a first of a plurality of CPWs of the PCB, and wherein the phase shifter comprises a first of a plurality of phase shifters of the PCB that are coupled to the CPWs, respectively.

10. The base station antenna of claim 1, wherein the CPW is further coupled to a third of the radiating elements.

11. The base station antenna of claim 10, wherein the second of the RF transmission lines is further coupled to a fourth of the radiating elements.

12. A base station antenna comprising:

a reflector comprising an opening therein;

a printed circuit board (PCB) on the reflector and comprising a phase shifter and a plurality of radio frequency (RF) transmission lines that are coupled to the phase shifter; and a plurality of radiating elements that are on the PCB and coupled to the plurality of RF transmission lines, wherein a first of the plurality of RF transmission lines is coupled to a first of the plurality of radiating elements and comprises a coplanar waveguide (CPW) that overlaps the opening of the reflector.

13. The base station antenna of claim 12, wherein the first of the RF transmission lines further comprises a microstrip line that is coupled to the CPW.

14. The base station antenna of claim 13, wherein the CPW is coupled to the phase shifter by the microstrip line.

15. The base station antenna of claim 13, wherein the CPW is coupled to the first of the radiating elements by the microstrip line.

16. The base station antenna of claim 13, wherein the microstrip line comprises a first of a pair of microstrip lines of the first of the RF transmission lines, and wherein the CPW is coupled between the pair of microstrip lines.

17. A base station antenna feed board comprising:

a phase shifter;

first and second radiating elements;

a hybrid radio frequency (RF) transmission line that is coupled to the phase shifter and includes a coplanar waveguide (CPW) and a microstrip line, wherein the hybrid RF transmission line is coupled between the phase shifter and the first radiating element; and a non-CPW RF transmission line that is coupled between the phase shifter and the second radiating element, wherein a length of the hybrid RF transmission line between the phase shifter and the first radiating element is longer than a length of the non-CPW RF transmission line between the phase shifter and the second radiating element of the base station antenna feed board.

18. The base station antenna feed board of claim 17, wherein the microstrip line is a first microstrip line coupled between the CPW and the phase shifter, and wherein the hybrid RF transmission line further comprises a second microstrip line coupled between the CPW and the first radiating element.

19. The base station antenna feed board of claim 17, wherein the CPW comprises:

two outer conductive lines on a first surface of the base station antenna feed board;

a center conductive line that is coupled to the microstrip line and is between the two outer conductive lines on the first surface of the base station antenna feed board; and grounded vias that couple the two outer conductive lines to a ground plane that is on a second surface of the base station antenna feed board that is opposite the first surface.

20. The base station antenna feed board of claim 19, further comprising:

a second-layer conductive line that is on the second surface of the base station antenna feed board and is overlapped by the center conductive line; and ungrounded vias that couple the center conductive line and the second-layer conductive line to each other, wherein the ground plane comprises first and second portions that are overlapped by the two outer conductive lines, respectively, and wherein the ground plane further comprises an opening that separates the second-layer conductive line from the first and second portions of the ground plane.

21. A base station antenna feed board comprising:

a phase shifter;

first and second radiating elements; and first and second radio frequency (RF) transmission lines that are coupled to the phase shifter and configured to have first and second RF wave speeds, respectively, wherein the second RF wave speed is slower than the first RF wave speed, wherein the first RF transmission line is coupled between the phase shifter and the first radiating element, and wherein the second RF transmission line is coupled between the phase shifter and the second radiating element wherein the first RF transmission line comprises a coplanar waveguide (CPW), and wherein the second RF transmission line is a non-CPW RF transmission line.

22. The base station antenna feed board of claim 21, wherein the first RF transmission line comprises a coaxial RF transmission line having a shield and a center conductor that is separated from the shield by air.

23. The base station antenna feed board of claim 21, wherein the first RF transmission line comprises a conductive line that is separated from a ground plane of the base station antenna feed board by air.

24. The base station antenna feed board of claim 21, wherein the first RF transmission line is longer in length between the phase shifter and the first radiating element than a length of the second RF transmission line between the phase shifter and the second radiating element.

25. The base station antenna feed board of claim 23, further comprising:

a reflector, wherein a substrate of the base station antenna feed board is between the ground plane and the reflector.

* * * * *